United States Patent [19]

Sweeney et al.

[11] 4,353,710

[45] Oct. 12, 1982

[54] NOVEL METHOD OF EXTENDING A HYDROCARBON FUEL HEAVIER THAN GASOLINE BY ADDING A METHOXY OR ETHOXY GROUP

[75] Inventors: William M. Sweeney, Wappingers Falls; Sheldon Herbstman, Spring Valley, both of N.Y.

[73] Assignee: Texaco Inc., White Plains, N.Y.

[21] Appl. No.: 134,033

[22] Filed: Mar. 26, 1980

[51] Int. Cl.[3] ..... C10L 1/18

[52] U.S. Cl. ..... 44/56; 44/60; 44/70; 44/77

[58] Field of Search ..... 44/56, 60, 70, 77

[56] References Cited

U.S. PATENT DOCUMENTS

| | | | |
|---|---|---|---|
| 1,331,054 | 2/1920 | Dinsmore | 44/70 |
| 1,423,049 | 7/1922 | Tunison | 44/56 |
| 2,132,017 | 10/1938 | Evans | 44/56 |
| 2,384,866 | 9/1945 | Wiczer | 44/56 |

*Primary Examiner*—Charles F. Warren
*Assistant Examiner*—Y. Harris-Smith
*Attorney, Agent, or Firm*—Carl G. Ries; Robert A. Kulason; Carl G. Seutter

[57] ABSTRACT

Hydrocarbon fuels heavier than gasoline may be extended by addition thereto of ether or ester fuel extenders, soluble in the hydrocarbon fuel, having a molecular weight of about 65–200 and characterized by the presence of at least one methoxy group or ethoxy group. The product is a single-phase mixture which is free of methanol or ethanol.

14 Claims, No Drawings

NOVEL METHOD OF EXTENDING A HYDROCARBON FUEL HEAVIER THAN GASOLINE BY ADDING A METHOXY OR ETHOXY GROUP

FIELD OF THE INVENTION

This invention relates to a novel method of extending liquid hydrocarbon fuels heavier than gasoline including middle distillate liquid hydrocarbons. More particularly it relates to the extension of a furnace oil with methoxy compounds or ethoxy compounds.

BACKGROUND OF THE INVENTION

As is well known to those skilled in the art, hydrocarbon fuels heavier than gasoline including middle distillate hydrocarbon fuels, typified by furnace oils or fuel oils may become in short supply as refiners attempt to obtain higher percentages of gasoline from crude oils. Attempts to extend these fuels by addition thereto of methanol or ethanol for example, have not heretofore been satisfactory because these fuels (such as No. 2 furnace oil) will only dissolve eg methanol to the extent of a percent or two.

It is an object of this invention to provide a method of extending hydrocarbon fuels heavier than gasoline including middle distillate fuels. Other objects will be apparent to those skilled in the art.

STATEMENT OF THE INVENTION

In accordance with certain of its aspects, this invention is directed to a method of extending a hydrocarbon fuel heavier than gasoline which comprises mixing (i) a hydrocarbon fuel heavier than gasoline and as a fuel extender, (ii) a composition, having a molecular weight of about 65–200, soluble in said hydrocarbon fuel, and characterized by the presence of at least one methoxy group or ethoxy group-thereby forming a single phase extended hydrocarbon fuel heavier than gasoline which is free of methanol and ethanol; and recovering said single phase extended hydrocarbon fuel heavier than gasoline which is free of methanol or ethanol.

In accordance with certain of its other aspects, this invention is directed to a novel single-phase extended hydrocarbon fuel heavier than gasoline which is free of ethanol or methanol, which comprises (i) a hydrocarbon fuel heavier than gasoline and, as a fuel extender, (ii) an ether or ester having a molecular weight of about 65–200, soluble in said hydrocarbon fuel characterized by the presence of at least one methoxy group or ethoxy group.

DESCRIPTION OF THE INVENTION

The hydrocarbon fuels heavier than gasoline which may be extended by the process of this invention include those which typically have an initial boiling point (ibp) above about 320° F. Typically such fractions may be identified as kerosene, diesel oil or furnace oil, fuel oil, light gas oil, heavy gas oil, light cycle gas oil, heavy cycle gas oil, vacuum gas oil etc. These fractions which include middle distillates commonly have an initial boiling point above about 340° F. and may have end points as high as 1100° F. They typically have an API gravity below about 40.

In the case of a kerosene, the fuel may be characterized by an ibp of 300° F.–400° F., say 350° F., an ep of 500° F.–600° F., say 550° F., and an API gravity of 30–70, say 50.

In the case of a diesel oil or furnace oil, the fuel may be characterized by an ibp of 325° F.–425° F., say 350° F., an ep of 575° F.–690° F., say 610° F., and an API gravity of 25–50, say 40.

In the case of a vacuum gas oil, the fuel may be characterized by an ibp of 600° F.–700° F., say 650° F., an ep of 900° F.–1100° F., say 1050° F., and an API gravity of 10–35, say 25.

In the case of a light cycle gas oil, it may be characterized by an ibp of 300° F.–400° F., say 350° F., an ep of 575° F.–670° F., say 610° F., and an API gravity of 20–40, say 30.

In the case of a heavy cycle gas oil, it may be characterized by an ibp of 500° F.–550° F., say 525° F., an ep of 600° F.–700° F., say 680° F., and an API gravity of 20–35, say 25.

In the case of a residual fuel oil, it may be characterized by an API gravity of 5–25, say 20.

Illustrative fuels which may be treated by the process of this invention include (i) a No. 2 furnace oil having an ibp of 376° F., an ep of 623° F., an API gravity of 35, and a cetane number of 47.5; (ii) a vacuum gas oil having an ibp of 680° F., and ep of 1050° F., and an API gravity of 25.

These hydrocarbon fuels heavier than gasoline are characterized by the fact that methanol and ethanol (in the presence of very small amounts of water eg 0.1 w %) are substantially insoluble therein—typically less than 10 w % and in some cases less than 1–2 w %. It is a feature of this invention that the advantages sought by use of methanol and ethanol as fuel extenders can be obtained by converting methanol and ethanol to ether or ester derivatives thereof which are characterized by substantially complete miscibility with the fuels, even in the presence of water. The derivatives which may be readily prepared or which may be commercially available are advantageous because (i) they are miscible with hydrocarbon fuels heavier than gasoline and (ii) they have heavier molecular weight than ethanol and methanol and thus generally yield a product mix having higher initial boiling point.

Furthermore the ability to convert methanol or ethanol to their methoxy- or ethoxy-containing derivatives permits attainment of product fuel compositions which are free of the lighter methanol and ethanol, and thus have increased flash point.

The ether or ester compositions which may be used in practice of the process of this invention include ethers having the formula R′—R; and esters having the formula R′-OCR. A preferred class of esters has the formula R′—R″ OOCR.

In these formulae, R′ is methoxy $CH_3O$— or ethoxy $C_2H_5O$—.

R may be a hydrocarbon radical selected from the group consisting of alkyl and cycloalkyl including such radicals when inertly substituted. When R is alkyl, it may typically be methyl, ethyl, n-propyl, iso-propyl, n-butyl, i-butyl, sec-buty, amyl, octyl, decyl, etc. When R is cycloalkyl, it may typically be cyclohexyl, cycloheptyl, cyclooctyl, 2-methylcycloheptyl, 3-butylcyclohexyl, 3-methylcyclohexyl, etc. R may be inertly substituted i.e. it may bear a non-reactive substituent such as alkyl, aryl, cycloalkyl, ether, halogen, etc. Typically inertly substituted R groups may include 3-chloropropyl, 2-ethoxyethyl, carboethoxymethyl, 4-methyl cyclohexyl, p-chlorophenyl, p-chlorobenzyl, 3-chloro- 5-methylphenyl, etc. The preferred R groups may be lower alkyl, i.e. $C_1$–$C_{10}$ alkyl, groups including eg methyl, ethyl, n-propyl, i-propyl, butyls, amyls, hexyls, octyls, decyls, etc.

R″ may be selected from the same group as R subject to the fact that it contains one less hydrogen atom or equivalently one additional bond.

Illustrative ethers R′—R which may be employed include:

TABLE methyl, butyl ether
methyl, t-butyl ether
methyl, 2-ethylhexyl ether
ethyl, butyl ether
ethyl, t-butyl ether Illustrative esters R′—OCR which may be employed include:

TABLE methyl acetate
methyl proprionate
methyl butyrate
ethyl acetate
ethyl proprionate
ethyl butyrate Illustrative esters R′—R″ OOCR which may be employed include:

TABLE 2-methoxyethyl acetate
3-methoxypropyl acetate
2-ethoxyethyl acetate
3-ethoxypropyl acetate
2-methoxyethyl propionate
2-ethoxypropyl propionate Preferred fuel extenders include:

TABLE 2-methoxyethyl acetate
ethyl acetate
methyl acetate

Although it is possible to add these extenders in amounts ranging from the very small (eg 0.01 v %) to very large (eg amounts of 1000+%) practical considerations dictate that they be present in the middle distillate hydrocarbon fuels in amount of 1–30 v %, preferably 5–25 v %, say about 20 v %. Alternatively expressed, they may be added in amount of about 1–50 parts, preferably 5–30, say 25 parts per 100 parts of fuel. These extenders (unlike eg methanol or ethanol) are essentially totally miscible with wet or dry hydrocarbon fuels heavier than gasoline.

A preferred composition may thus include:

| | |
|---|---|
| 80 parts | No. 2 furnace oil |
| 20 parts | 2-methoxyethyl acetate |
| Another preferred composition may include: | |
| 80 parts | desulfurized heavy vacuum gas oil |
| 20 parts | 2-methylethyl acetate |

It is a feature of these compositions that as prepared, they are single-phase compositions of improved stability over extended periods of time. In the presence of small amounts of water contacted over an extended period of time, the compositions may retain their single phase integrity.

Formation of these products is effected by mixing the desired quantities of extender and hydrocarbon fuel.

It may be possible, although less preferred, to formulate the compositions in situ; eg to react a two-phase mixture of fuel oil and methanol with e.g. acetic anhydride to form a fuel oil composition extended with methyl acetate. This is however much less preferred especially in the preferred embodiment in which it is particularly desired to employ extended fuel compositions which are free of methanol and/or ethanol.

It is a particularly desirable feature of the preferred methanol-free and ethanol-free compositions of this invention that they are stable in the presence of water since the extenders are substantially immiscible with water. If a fuel oil-methanol-ethyl acetate mixture (outside the scope of this invention) were contacted with water, the methanol of the fuel would be extracted and a two-phase mixture would be formed containing a water-methanol phase. In contrast, if a mixture of this invention eg fuel oil-2-methoxyethyl acetate be contacted with water, the water phase is found to be free of the 2-methoxyethyl acetate.

Practice of the process of this invention may be apparent to those skilled in the art from the following Examples wherein, as elsewhere in this specification, all parts are parts by weight unless otherwise specified.

DESCRIPTION OF PREFERRED EMBODIMENT

EXAMPLE I

In this Example, a No. 2 furnace oil (80 parts) having a cetane number of 47.5 is mixed with 2-methoxyethyl acetate (20 parts) fuel extender The product extended mix, having a cetane number of 41.8, is a homogeneous, single-phase mixture which does not separate on standing; and it is satisfactory for use in manner comparable to that in which the unextended composition may be employed.

EXAMPLE II

In this Example, a desulfurized heavy vacuum gas oil (80 parts) having a cetane number of 51.3, and containing 0.1 parts of Elvax 250 pour depressant, is mixed with 2-methoxyethyl acetate (20 parts) fuel extender. The product extended mix, having a cetane number of 47.0, is a homogeneous, single-phase mixture which does not separate on standing; and it is satisfactory for use in manner comparable to that in which the unextended composition may be employed.

Results comparable to Examples I–II may be attained if the extender is:

TABLE

| EXAMPLE | ADDITIVE |
|---|---|
| III | ethyl acetate |
| IV | methyl acetate |
| V | methyl, t-butyl ether |

Results comparable to the above may be obtained if the hydrocarbon component is:

TABLE

| EXAMPLE | HYDROCARBON |
|---|---|
| VI | Diesel oil |

TABLE-continued

| EXAMPLE | HYDROCARBON |
|---|---|
| VII | Light gas oil |

Although this invention has been illustrated by reference to specific embodiments, it will be apparent to those skilled in the art that various changes and modifications may be made which clearly fall within the scope of this invention.

I claim:

1. The method of extending a furnace oil which comprises mixing said furnace oil and 2-methoxyethyl acetate, said 2-methoxyethyl acetate being present in amount of about 1 v %–30 v % of total composition—thereby forming a single phase extended furnace oil, which is free of methanol or ethanol; and recovering said single phase extended furnace oil.

2. A novel single-phase extended furnace oil or diesel oil hydrocarbon fuel, which is free of methanol or ethanol, and which contains as a fuel extender, 2-methoxyethyl acetate, said fuel extender being present in amount of 1 v %–30 v % of total composition.

3. The method of extending a hydrocarbon fuel heavier than gasoline which comprises mixing (i) a hydrocarbon fuel heavier than gasoline and (ii) as a fuel extender, 2-methoxyethyl acetate thereby forming a single phase extended hydrocarbon fuel heavier than gasoline which is free of methanol or ethanol; and recovering said signal phase extended hydrocarbon fuel heavier than gasoline which is free of methanol or ethanol.

4. The method of extending a hydrocarbon fuel heavier than gasoline which comprises mixing (i) a hydrocarbon fuel heavier than gasoline and (ii) as a fuel extender, methyl butyrate thereby forming a single phase extended hydrocarbon fuel heavier than gasoline which is free of methanol or ethanol; and recovering said single phase extended hydrocarbon fuel heavier than gasoline which is free of methanol or ethanol.

5. The method of extending a furnace oil which comprises mixing said furnace oil and methyl butyrate, said methyl butyrate being present in amount of about 1 v %–30 v % of total composition—thereby forming a single phase extended furnace oil, which is free of methanol or ethanol; and recovering said single phase extended furnace oil.

6. A novel single-phase extended hydrocarbon fuel heavier than gasoline, which is free of ethanol or methanol, which comprises (i) a hydrocarbon fuel heavier than gasoline and, as a fuel extender, (ii) 2-methoxyethyl acetate.

7. A novel single-phase extended hydrocarbon fuel heavier than gasoline, which is free of ethanol or methanol, which comprises (i) a hydrocarbon fuel heavier than gasoline and, as a fuel extender, (ii) methyl butyrate.

8. A novel single-phase extended furnace oil or diesel oil hydrocarbon fuel, which is free of methanol or ethanol, and which contains as a fuel extender, methyl butyrate, said fuel extender being present in amount of 1 v %–30 v % of total composition.

9. The method of extending a hydrocarbon fuel heavier than gasoline which comprises mixing (i) a hydrocarbon fuel heavier than gasoline and as a fuel extender, (ii) methyl, butyl ether thereby forming a single-phase extended hydrocarbon fuel heavier than gasoline which is free of methanol and ethanol; and recovering said single phase extended hydrocarbon fuel heavier than gasoline which is free of methanol or ethanol.

10. The method of extending a hydrocarbon fuel heavier than gasoline which comprises mixing (i) a hydrocarbon fuel heavier than gasoline and as a fuel extender, (ii) methyl, t-butyl ether thereby forming a single phase extended hydrocarbon fuel heavier than gasoline which is free of methanol and ethanol; and recovering said single phase extended hydrocarbon fuel heavier than gasoline which is free of methanol or ethanol.

11. The method of extending a hydrocarbon fuel heavier than gasoline which is free of methanol and ethanol; and mixing (i) a hydrocarbon fuel heavier than gasoline and as a fuel extender, (ii) methyl, hexyl ether thereby forming a single-phase extended hydrocarbon fuel heavier than gasoline which is free of methanol and ethanol; and recovering said single-phase extended hydrocarbon fuel heavier than gasoline which is free of methanol or ethanol.

12. The method of extending a hydrocarbon fuel heavier than gasoline which comprises mixing (i) a hydrocarbon fuel heavier than gasoline and as a fuel extender, (ii) ethyl, t-butyl ether thereby forming a single phase extended hydrocarbon fuel heavier than gasoline which is free of methanol and ethanol; and recovering said single-phase extended hydrocarbon fuel heavier than gasoline which is free of methanol or ethanol.

13. A novel single-phase extended hydrocarbon fuel heavier than gasoline, which is free of ethanol or methanol, which comprises (i) a hydrocarbon fuel heavier than gasoline and, as a fuel extender, (ii) methyl, butyl ether.

14. A novel single-phase extended hydrocarbon fuel heavier than gasoline, which is free of ethanol or methanol, which comprises (i) a hydrocarbon fuel heavier than gasoline and, as a fuel extender, (ii) methyl, t-butyl ether.

* * * * *